United States Patent [19]

Ruggiero

[11] Patent Number: 5,068,930

[45] Date of Patent: Dec. 3, 1991

[54] INVALID'S BATHTUB SEAT

[76] Inventor: Joseph Ruggiero, 509 E. Broadway, Port Jefferson, N.Y. 11777

[21] Appl. No.: 542,540

[22] Filed: Jun. 25, 1990

[51] Int. Cl.[5] ..... A47K 3/02

[52] U.S. Cl. ..... 4/560; 4/579

[58] Field of Search ..... 4/560, 572, 578, 579, 4/547, 571, 573, 561, 562, 563

[56] References Cited

U.S. PATENT DOCUMENTS

| | | | |
|---|---|---|---|
| 2,045,110 | 6/1936 | Spiess | 4/562 |
| 2,237,076 | 4/1941 | Kenney et al. | 4/579 |
| 2,648,849 | 8/1953 | Webb et al. | 4/578 X |
| 3,203,008 | 8/1965 | Murcott | 4/578 X |
| 3,422,466 | 1/1969 | Banoczi | 4/579 X |
| 3,435,466 | 4/1969 | Cheney | 4/578 X |
| 4,091,479 | 5/1978 | Hancock | 4/578 X |
| 4,150,445 | 4/1979 | Bailey | 4/579 X |
| 4,168,549 | 9/1979 | Davies | 4/578 |
| 4,359,791 | 11/1982 | Thomas | 4/560 X |

FOREIGN PATENT DOCUMENTS

| | | | |
|---|---|---|---|
| 288047 | 10/1988 | European Pat. Off. | 4/579 |

*Primary Examiner*—Henry J. Recla
*Assistant Examiner*—Robert M. Fetsuga
*Attorney, Agent, or Firm*—Bernard J. Murphy

[57] ABSTRACT

Seat is journalled on an annular bearing, and is centrally apertured to permit cleansing of the invalid's personal parts. The seat is journalled, as aforesaid, on a track which is movable horizontally relative to a basic frame. Accordingly, the seat can be moved from an overhung disposition relative to an edge of a bathtub, to a centered disposition in the middle of the bathrub, and the seat can be turned from an outwardly-facing disposition thereof to a disposition turned ninety degrees therefrom. Limbs fixed to the frame support the frame within a bathrub, and an outwardly-extending arm is provided to engage an edge of the bathtub to insure against the apparatus tilting due to the weight of the invalid, especially when set upon the seat in the overhung disposition.

7 Claims, 4 Drawing Sheets

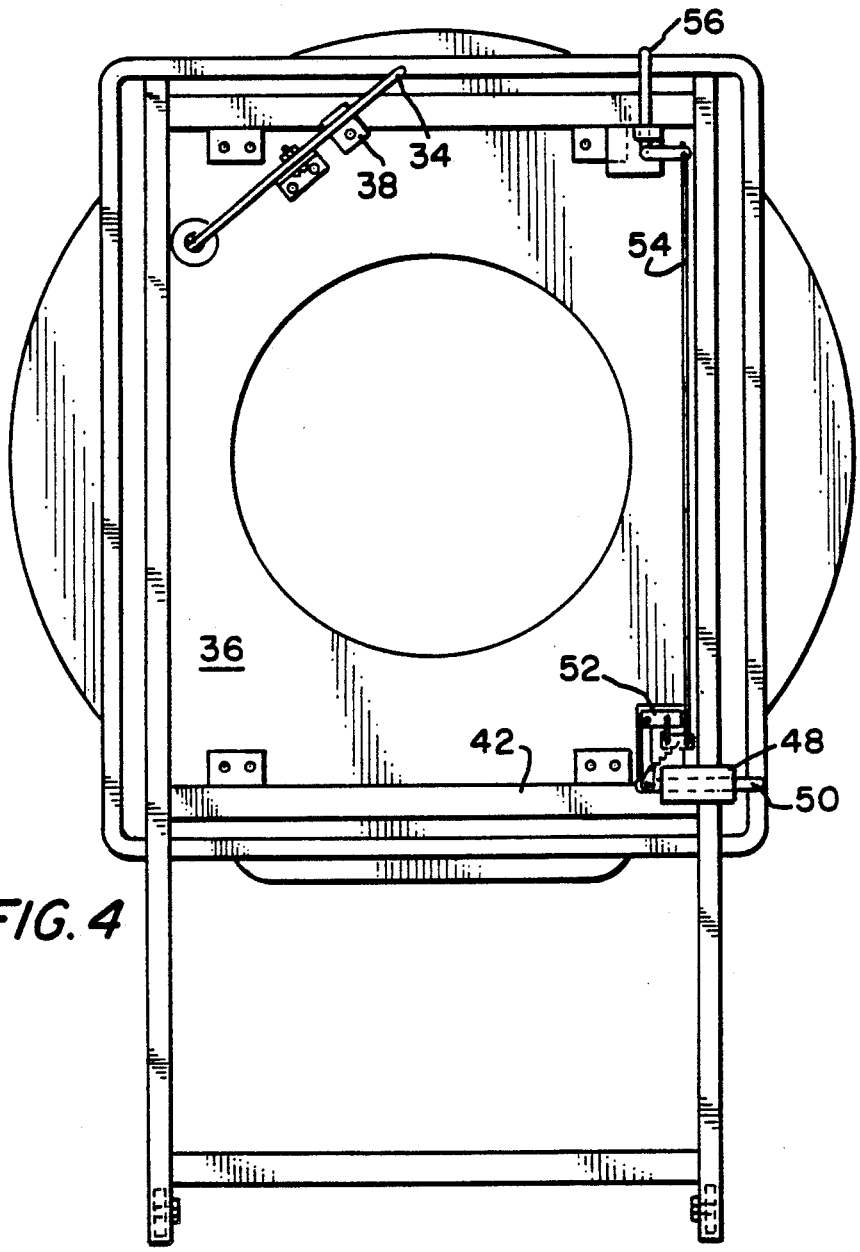
FIG. 4
FIG. 6
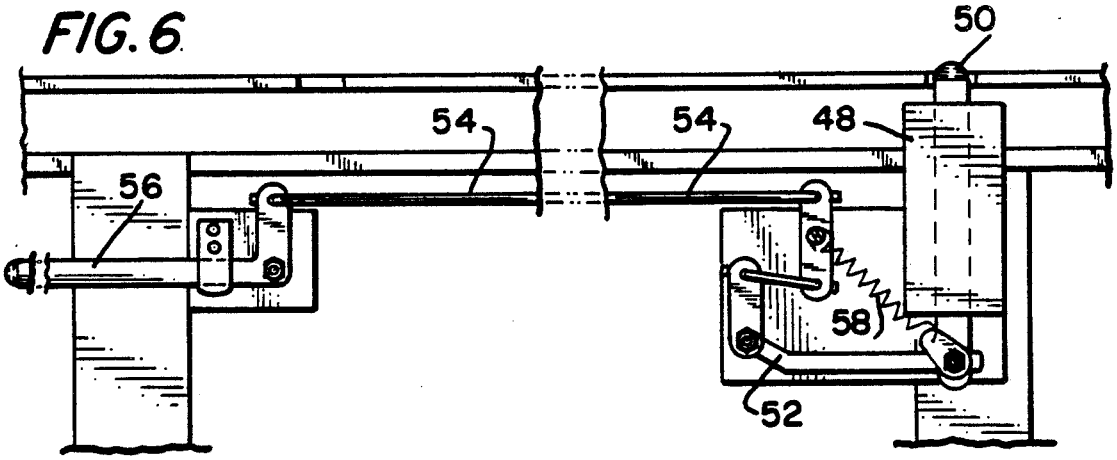

INVALID'S BATHTUB SEAT

This invention pertains to invalid aids and appliances, and in particular to an invalid's bathtub seat which i especially designed to facilitate the use of a shower-installation, by an invalid, within a bathtub.

Appliances of the type to which the invention pertains are exemplified by U.S. Pat. No. 2,045,110, issued to Otto Spiess, on June 23, 1936. The patented Bathtub Appliance, according to the Spiess design, has a rotatable seat which is set upon parallel straps, the straps being arrayed across a bathtub, and being coupled to a mechanism which losers the seat to the bottom of the bathtub.

The aforesaid Spiess patent, and like devices, are of limited utility in that, for one, they can not carry the seat to an edge of the bathtub to enable an invalid easy access thereto. Also, for being centrally journalled, the seats employed can not accommodate for the ablutions to the personal parts of the invalid.

What has been needed is an invalid's bathtub seat which can translate the seat between an outermost disposition, in which the seat overhangs an edge of the bathtub, to an innermost disposition, in which the seat is centrally located over the middle of the bathtub. Further, the need has been for such an invalid's bathtub seat which further is centrally apertured to permit cleansing of the invalid's personal parts.

It is an object of this invention to set forth just such a long-sought invalid's bathtub seat.

It is particularly an object of this invention to set forth an invalid's bathtub seat comprising a frame having (a) a platform, and (b) limbs, for supporting said platform within a bathtub, attached to said platform; a seat, coupled to said platform, and journalled thereon for universal rotation; said seat having a central aperture; and wherein said frame has a reciprocable track, to which said seat is coupled, and upon which said seat is rotatably journalled, as aforesaid; said track comprising means for accommodating horizontal movement of said seat relative to said platform.

Further objects of this invention, as well as the novel features thereof, will become more apparent by reference to the following description, taken in conjunction with the accompanying figures, in which:

FIG. 4 is a bottom view of the rotatably journalled seat and track roller arrangement;

FIG. 6 is a fragmentary illustration detailing the track locking means; and

Figure 1:
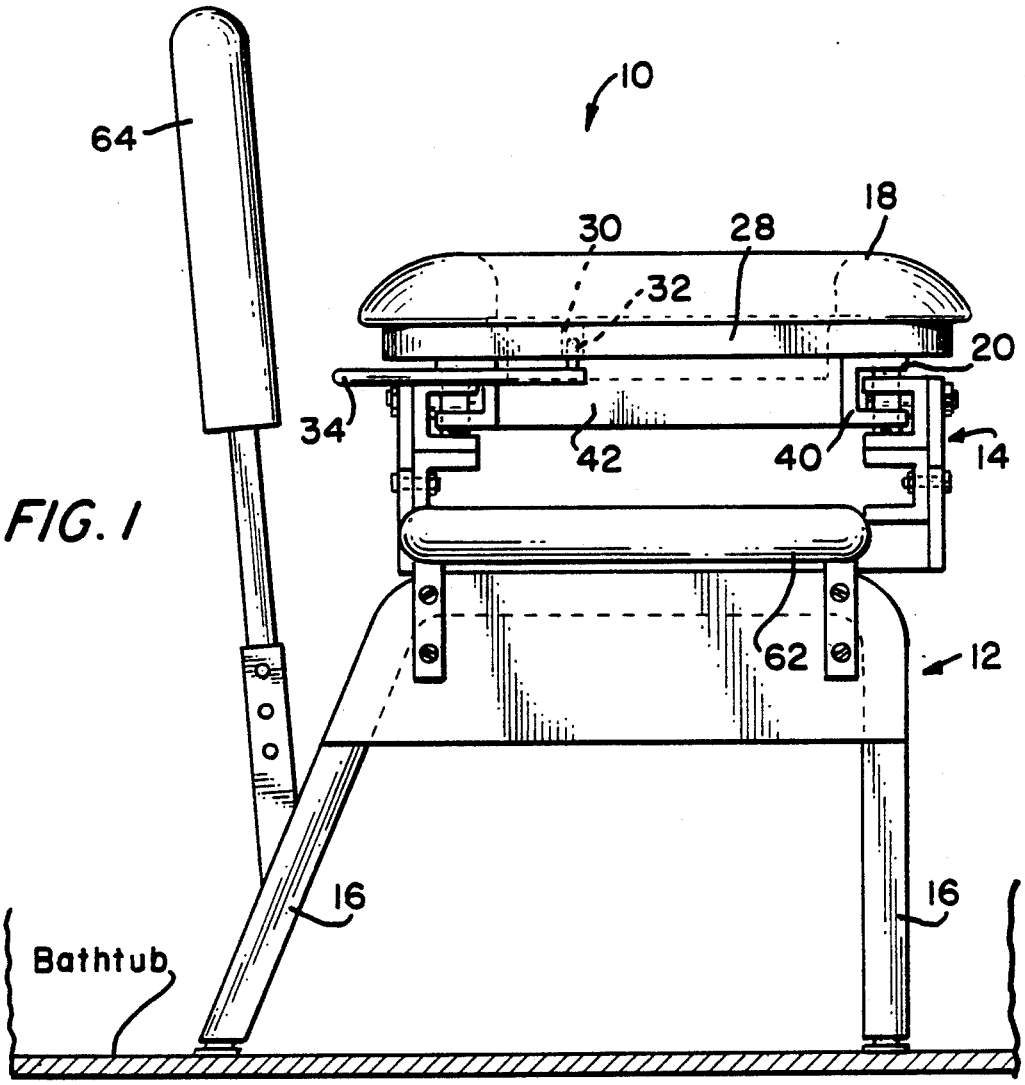
FIG. 1 is a side elevational view of the novel invalid's bathtub seat, according to an embodiment thereof.
Figure 5:
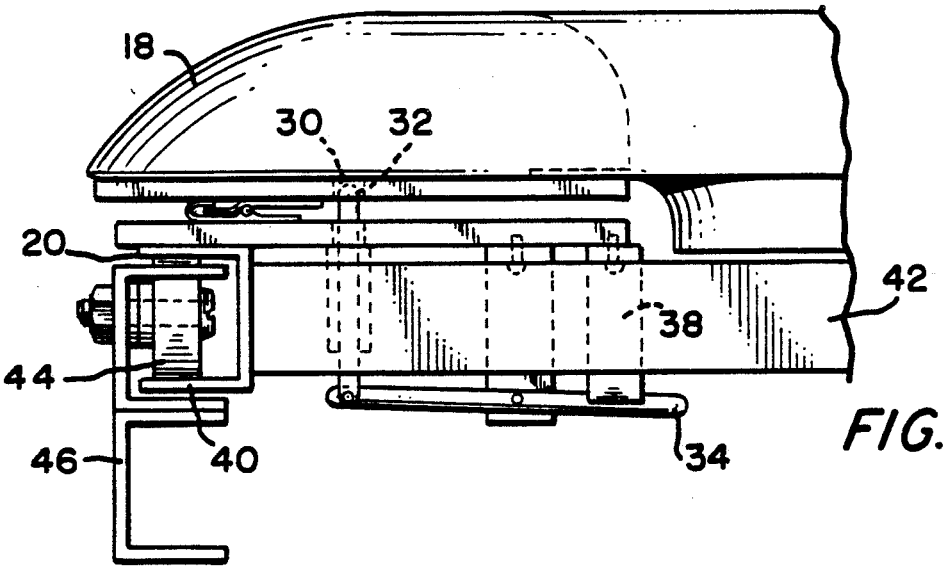
FIG. 5 is a discontinuous illustration of the seat locking means, and the track roller arrangement.
Figure 2:
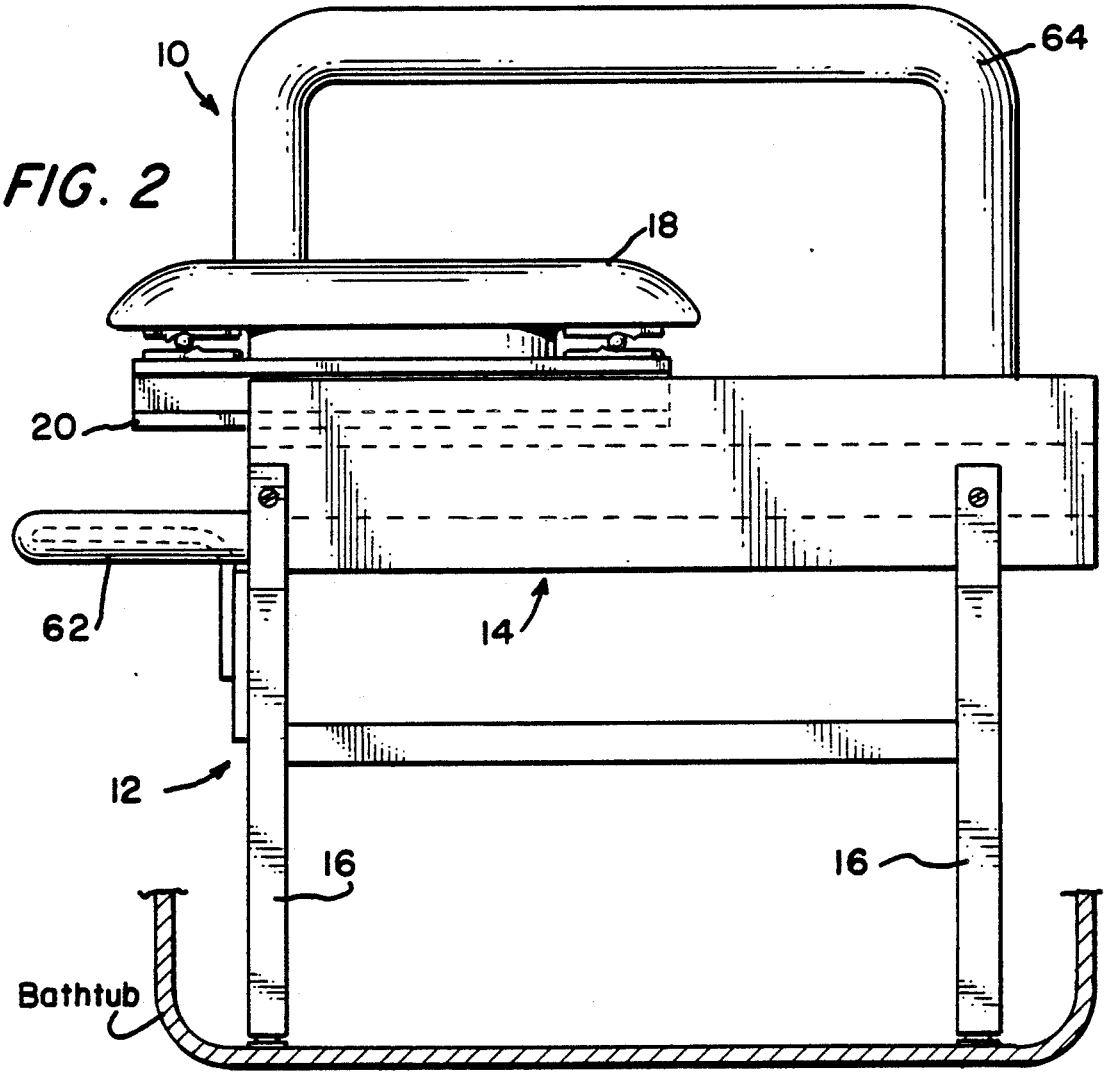
FIG. 2 is an elevational view of the invention, the same taken from the right-hand side of FIG. 1.
Figure 7:
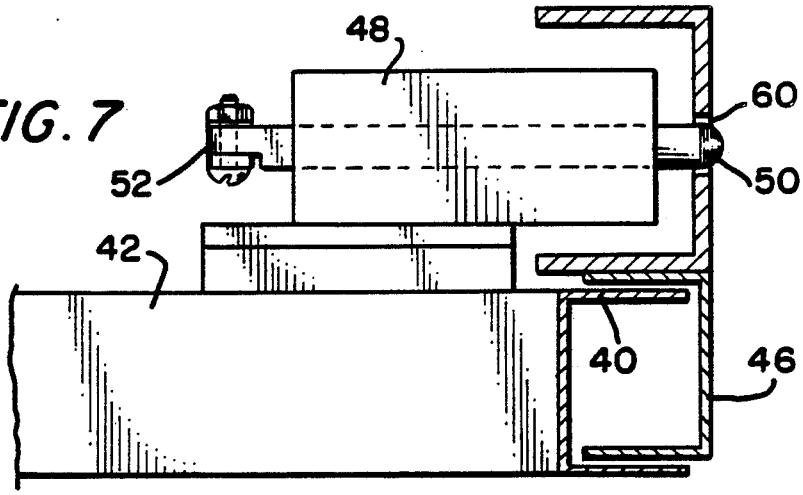
FIG. 7 is a view of the aforesaid track locking means, the same taken from the right-hand side of FIG. 6.
Figure 3:
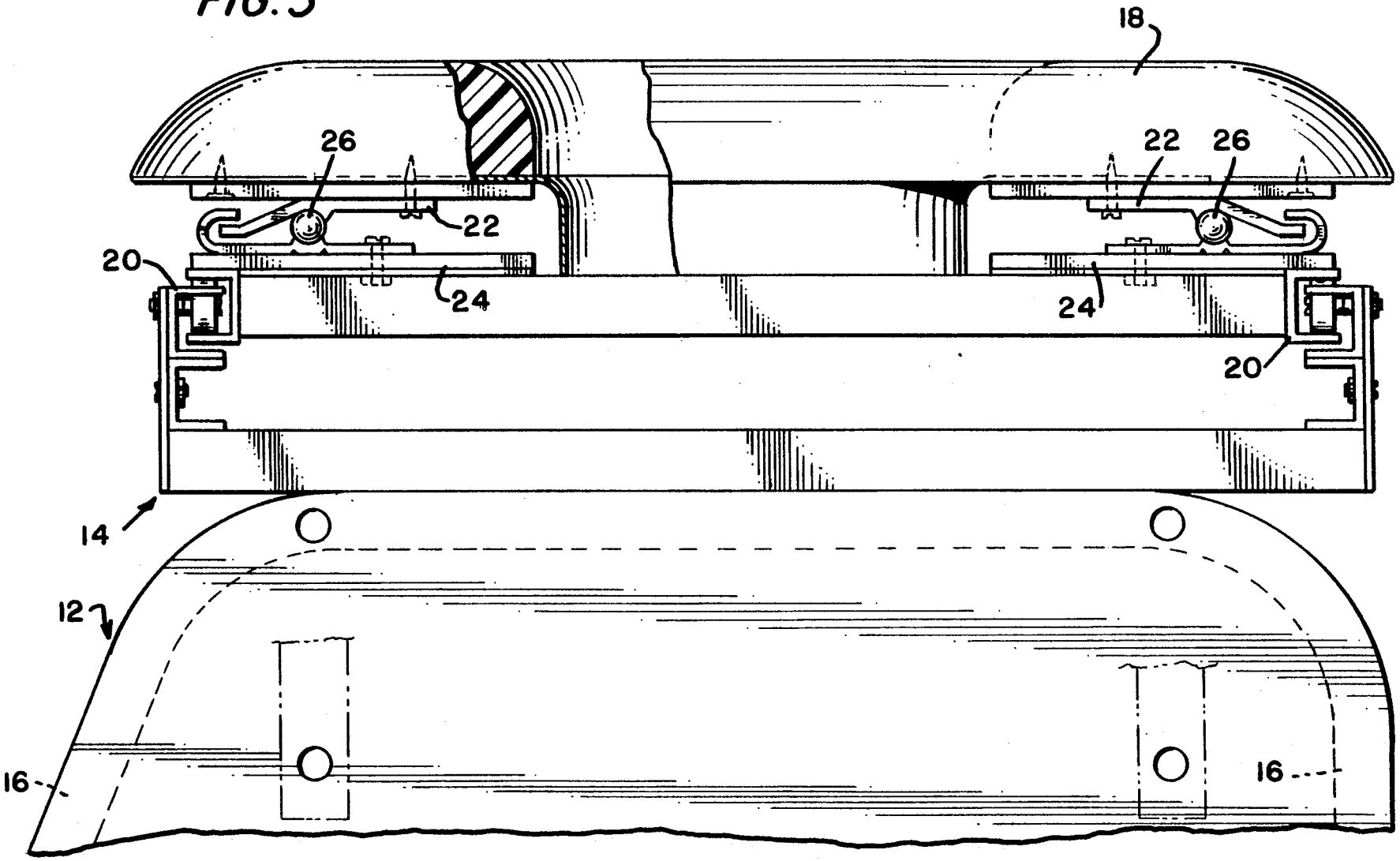
FIG. 3 is an enlarged illustration depicting the rotatable mounting of the seat and the track roller arrangement.

As shown in he figures, the novel invalid's bathtub seat 10 comprises a frame 12 which has a platform 14 and limbs 16 for supporting the platform 14, elevated, within a bathtub. A seat 18, which has a fully open, central aperture to allow water to flow therethrough, to accommodate for ablutions of an invalid's personal parts, is rotatably coupled to a track 20. An upper turntable plate 22 is fastened to the underside of the annular seat 18, and a lower turntable plate 24 is fastened to the track 20. Each plate is so contoured, in confronting surfaces thereof, as to hold captive therebetween a multiplicity of bearing balls 26. Accordingly, the seat 18 is universally journalled.

Means are provided for releasably locking the seat 18 in a selected rotary disposition. The base 28 of the seat 18 has a borehole 30 formed therein, and a lever-actuated locking pin 32 slidably engages the borehole 30. The pin 32 is perpendicularly joined to a pivotable lever 34, the latter is pivotably mounted to a turntable plate 36, and is biased to hold the pin 32 in the locking disposition by a spring 38. An end of the lever 34 projects beyond the seat 18 where it is accessible for manipulation. By use of the lever 34, the pin 32 can be withdrawn from the borehole 30 so that the seat 18 can be rotated to face a side of a bathtub in which the invention is set. Then, with the invalid seated upon the seat, the seat can be rotated until it locates the borehole 30 above the pin 32; the pin 32 re-engages the borehole 30 and, consequently the seat is locked in a disposition in which the invalid's legs are within the bathtub.

The novel invention 10 also comprises means for translating the seat 18 from an overhung disposition at a side of a bathtub to a disposition centrally located within the middle of the tube. The track 20 comprises C-shaped beams 40, joined thereacross by spreader bars 42. Bearing-mounted rollers 44 are rotatably mounted to weldments 46 of the frame 12, and the beams 40 are set upon the rollers and, as a consequence thereof, the track 20 is free to traverse along the frame weldments 46 to carry the seat 18 between the aforesaid overhung disposition to the centrally located, bathtub middle disposition.

Further means are provided for releasably locking the track in a selected translated disposition. The frame weldments 46, at one side thereof, carry a locking plunger guide 48 which slidably accommodates a locking plunger 50. An innermost end of the plunger 50 is pivotably coupled to a linkage 52. The furthest end of the linkage 52 is coupled to a tie rod 54. In turn, the opposite end of the tie rod is joined to a pivotable lock release lever 56. A spring 58 held between the linkage 52 and the innermost end of the plunger 50 biasingly urges the plunger into a locking disposition with a hole 60 provided therefor in the side weldment 46. By this means, the seat 18 can be moved to the aforesaid overhung disposition, with the seat facing out toward the outside of the bathtub. Then the seat can be rotated ninety degrees, and moved to the center of the bathtub, by the aforedescribed rollers 44, to dispose an invalid in the very center of the bathtub with the invalid's legs therewithin. As the seat 18 and track 20 come to the center of the bathtub, the spring 5 causes the plunger 50 to enter the hole 60 thereby locking the seat ad track 20 in its disposition. Of course, manipulation of the lever 56 releases the plunger 50 from the hole 60 to permit the invalid to be moved out to the seat overhung attitude.

With the seat 18 in the overhung disposition, the weight of the invalid, ordinarily, would cause the novel apparatus to tilt. However this is prevented by the provisioning of an arm 62 which is fastened to the frame 12. The arm 62 is rubber-covered to insure against scratching the finish of the bathtub. Additionally, the arm 62 is adjustable in elevation, relative to the frame 12, to accommodate for bathtubs of differing side heights. Additionally, a foam-padded back rest 64 is fastened to the frame 12. It too is adjustable in elevation to meet the comfort of the invalid.

As will be appreciated, the novel invalid's bathtub seat 10 makes it possible for an invalid to be brought to the side of the bathtub and seated, with the legs outside of the bathtub. Then the seat 18 can be both translated along the frame 12 and rotated ninety degrees to accommodate the invalid in the very center of the bathtub, and with the legs therewithin. Subsequently, then, the invalid can be either bathed, with bath water, or showered by means of a bathtub-shower installation. In that the seat 18 is journaled on an annulus and has a fully open, central aperture the invalid's genital and anal areas can be cleansed readily.

While I have described my invention in connection with a specific embodiment thereof, it is to be clearly understood that this is done only by way of example, and not as a limitation to the scope of my invention, as set forth in the objects thereof and in the appended claims.

I claim:

1. An invalid's bathtub seat, comprising:

a frame having (a) a platform, and (b) limbs, for supporting said platform within a bathtub, attached to said platform;

a seat, coupled to said platform, and journalled thereon for universal rotation;

said seat having a fully open central aperture; and wherein said frame has a reciprocable track, to which said seat is coupled, and upon which said seat is rotatably journalled, as aforesaid;

said track comprising means for accommodating horizontal movement of said seat relative to said platform.

2. An invalid's bathtub seat, comprising:

a frame having (a) a platform, and (b) limbs, for supporting said platform within a bathtub, attached to said platform;

a seat, coupled to said platform, and journalled thereon for universal rotation;

said seat having a central aperture; and wherein said frame has a reciprocable track, to which said seat is coupled, and upon which said seat is rotatably journalled, as aforesaid;

said track comprising means for accommodating horizontal movement of said seat relative to said platform; and said track has a plurality of rollers, rotatably mounted thereto, which engage said platform to effect the aforesaid horizontal movement of said track.

3. An invalid's bathtub seat, comprising:

a frame having (a) a platform, and (b) limbs, for supporting said platform within a bathtub, attached to said platform;

a seat, coupled to said platform, and journalled thereon for universal rotation;

said seat having a central aperture; and wherein said frame has a reciprocable track, to which said seat is coupled, and upon which said seat is rotatably journalled, as aforesaid;

said track comprising means for accommodating horizontal movement of said seat relative to said platform; and said frame further has an arm, projecting outwardly therefrom, for engagement with an outer edge of a bathtub to stabilize said bathtub seat.

4. An invalid's bathtub seat, according to claim 1, further including:

means coupled to said track for releasably locking said rotatably journalled seat in a selected rotation.

5. An invalid's bathtub seat, according to claim 1, further including:

means coupled to said platform for releasably locking said seat in a selected, horizontally-moved disposition relative to said track.

6. An invalid's bathtub seat, comprising:

a frame having (a) a platform, and (b) limbs, for supporting said platform within a bathtub, attached to said platform;

a seat, coupled to said platform, and journalled thereon for universal rotation;

said seat having a central aperture; and wherein said frame has a reciprocable track, to which said seat is coupled, and upon which said seat is rotatably journalled, as aforesaid;

said track comprising means for accommodating horizontal movement of said seat relative to said platform; and further including means coupled to said track for releasably locking said rotatably journalled seat in a selected rotation; and wherein said locking means is resiliently biased in a locking disposition.

7. An invalid's bathtub seat, comprising:

a frame having (a) a platform, and (b) limbs, for supporting said platform within a bathtub, attached to said platform;

a seat, coupled to said platform, and journalled thereon of universal rotation;

said seat having a central aperture; and wherein said frame has a reciprocable track, to which said seat is coupled, and upon which said seat is rotatably journalled, as aforesaid;

said track comprising means for accommodating horizontal movement of said seat relative to said platform; and further including means coupled to said platform for releasably locking said seat in a selected, horizontally-moved disposition relative to said track; and wherein said locking means is resiliently biased in a locking disposition.

* * * * *